United States Patent [19]

Krautter et al.

[11] 4,409,865

[45] Oct. 18, 1983

[54] CONTINUOUS RATCHET DRIVE

[75] Inventors: Wilhelm F. Krautter, Portland, Pa.; John K. Junkers, Saddle River, N.J.

[73] Assignee: Unex Corporation, Montclair, N.J.

[21] Appl. No.: 225,407

[22] Filed: Jan. 15, 1981

[51] Int. Cl.[3] ..... B25B 13/46

[52] U.S. Cl. ..... 81/57.39; 74/143; 74/158

[58] Field of Search ..... 81/57.39, 61; 74/577 R, 74/577 M, 577 S, 143, 158, 159; 254/109

[56] References Cited

U.S. PATENT DOCUMENTS

| | | | |
|---|---|---|---|
| 658,276 | 9/1900 | McCariston | 254/109 |
| 1,823,760 | 9/1931 | Pierce | 74/143 |
| 2,723,580 | 11/1955 | Brame | 81/57.39 |
| 2,961,904 | 11/1960 | Sergan | 81/57.39 |
| 4,200,011 | 4/1980 | Wilmeth | 81/57.39 |
| 4,233,865 | 11/1980 | Junkers | 81/57.39 |

*Primary Examiner*—James L. Jones, Jr.
*Attorney, Agent, or Firm*—Michael J. Striker

[57] ABSTRACT

A ratchet drive comprises a support on which a ratchet gear is mounted turnably about a first pivot axis. A lever is mounted on the support tiltable about a second pivot axis spaced from and parallel to the first pivot axis between a forward stroke and a return stroke. A pair of drive pawls are mounted at one of the ends thereof on the lever tiltable about axes located spaced from and respectively to opposite sides of the second pivot axis and engaging with the other end thereof the ratchet gear, so that when the lever is moved along its forward stroke, one of the drive pawls will engage a tooth of the ratchet gear to turn the latter in one direction while the other pawl moves rearwardly over a tooth and so that during the return stroke the other pawl engages a tooth of the ratchet gear to turn the latter in the same direction while the one pawl moves rearwardly over a tooth. The ratchet drive may be used for turning a threaded connector, in which case a ratchet gear is either provided with a polygonal passage therethrough adapted to engage with the polygonal head of a threaded connector to be turned or with a coaxial projection of polygonal cross section extending beyond the support on which a socket for engaging the head of a threaded connector is exchangeably mounted. The lever may be moved along its forward and its return stroke by a fluid operated cylinder-and-piston unit mounted on the support.

1 Claim, 5 Drawing Figures

CONTINUOUS RATCHET DRIVE

BACKGROUND OF THE INVENTION

Various ratchet drives are known in the art in which a ratchet gear mounted on a support is turnable about it axis, and a lever pivotable about a second axis, extending laterally from and parallel to the axis of the ratchet gear is mounted on the support for movement between a forward stroke and a return stroke. The lever carries at least one drive pawl which is mounted on one of the ends thereof on the lever tiltable about an axis spaced from the second axis and this pawl engages with the other end thereof the ratchet gear. When the lever is now tilted, by hand or by any mechanical means connected thereto, along its forward stoke, the free end of the pawl will engage a tooth of the ratchet gear to drive the latter in one direction, whereas during the return stroke, the pawl will ratchet over the adjacent tooth, so that the ratchet gear will be turned through a predetermined angle only during the forward stroke of the lever. In this known construction a holding pawl is usually provided which engages a tooth of the ratchet gear during the return stroke of the lever, to prevent turning of the ratchet gear in opposite direction during the return stroke of the lever and during ratcheting of the drive pawl over a tooth of the ratchet gear.

Such known ratchet drives may be used for many purposes and especially in a wrench for turning a threaded connector. In this case the ratchet gear may be provided with a polygonal passage therethrough, coaxial with the second pivot axis, for engagement with a polygonal head of a threaded connector to be turned, or with a polygonal drive connection projecting beyond the support, on which a standard socket for engagement with the polygonal head of the threaded connector is exchangeably mounted to be turned during turning of the ratchet gear. In such a construction fluid operated cylinder and piston means are interconnected between the support and the lever for tilting the lever between the forward and the return stroke during reciprocation of the piston in the cylinder of the unit.

The evident disadvantage of this known ratchet drive is that the ratchet gear will be turned only during the forward stroke of the lever, while remaining stationary during the return stroke of the latter.

SUMMARY OF THE INVENTION

It is an object of the present invention to provide a ratchet drive which avoids the aforementioned disadvantage of the known ratchet drives, that is to provide a continuous ratchet drive, in which the ratchet gear is turned through predetermined angles during the forward stroke as well as during the return stroke of the lever.

It is a further object of the present invention to avoid the necessity of providing a separate holding pawl to prevent movement of the ratchet gear in a direction opposite to the direction it is moved during forward stroke of the lever.

It is an additional object of the present invention to provide a continuous ratchet drive which is especially suitable for use in a wrench for turning a threaded connector in one direction during the forward stroke as well as during the return stroke of the lever.

With these and other objects in view, which will become apparent as the description proceeds, the ratchet drive according to the present invention mainly comprises support means, a ratchet gear mounted on the support means turnable about a first pivot axis, lever means mounted on the support means pivotable about a second pivot axis extending laterally from and parallel to the first pivot axis between a forward stroke and a return stroke, a pair of drive pawls each mounted at one of the ends thereof on the lever means tiltable about axes located spaced from and respectively to opposite sides of the second pivot axis to engage with the other end thereof the ratchet gear. The lever means may be tilted about the second pivot axis by hand or preferably by mechanical means connected thereto between the forward and the return stroke thereof, whereby during the forward stroke one of the pawls engages a tooth of the ratchet gear to drive the latter in one direction while the other pawl ratchets rearwardly over a tooth, while during the return stroke of the lever the other pawl engages a tooth of the ratchet wheel to drive the latter in the same direction, while the one pawl ratchets rearwardly over a tooth, so that the ratchet gear is continuously turned about the first axis during the forward and the return stroke of the lever means.

If mechanical means are provided for tilting the lever means between the forward and the return stroke, such means pivotally engage the lever means at a point distant from the second pivot axis.

If the ratchet drive is to be used for turning the polygonal head of a threaded connector, then the ratchet gear is provided with means coaxial with the second pivot axis for engagement with the polygonal head of the threaded connector to be turned. Such means may comprise a polygonal passage through the ratchet gear coaxial with the first pivot axis for engagement with the polygonal head of a threaded connector to be turned, or a polygonal extension of the ratchet gear coaxial with the first pivot axis and projecting beyond the support means on which a standard socket for engagement with a polygonal head of a threaded connector to be turned is exchangeably mounted.

If the ratchet drive according to the present invention is used for turning the polygonal head of a threaded connector, then the means for tilting the lever means between its forward and its return stroke preferably comprise fluid operated cylinder-and-piston means.

In such a construction the fluid operated cylinder-and-cylinder means may comprise a cylinder pivoted in the region of one end on the support means, a piston reciprocatably arranged in the cylinder and having a piston rod fixed at one end to the piston and projecting with the other end thereof in a sealed manner through the other end of the cylinder, with the other end of the piston rod pivotabley connected to the lever means, and valve means are provided for alternatingly feeding pressure fluid to opposite sides of the piston in the cylinder to reciprocate the piston along a forward stroke and a return stroke in the cylinder.

In such a construction the pressure fluid will act during the forward stroke of the piston in the cylinder on the one end face of the piston directed toward the one end of the cylinder and during the return stroke on an annular surface which is reduced by the cross section of the piston rod with respect to the one end face of the piston, so that the force with which the piston is moved during the return stroke is smaller than that at which it is moved during the forward stroke. To compensate for the different forces acting on the piston during the forward and the return strokes and to assure that the ratchet gear is turned with the same moment during the forward stroke and the return stroke of the lever, the distance of the tilting axis at which the one end of one pawl is mounted on the lever means from the second pivot axis to the distance of the tilting axis from the one end of the other pawl from the second pivot axis is in reverse ratio to the forces at which the piston is moved during its forward and its return stroke.

In another embodiment according to the present invention the cylinder and piston means comprise a cylinder stationarily mounted on the support means, a piston reciprocatably arranged in the cylinder and having a central portion pivotally connected to an end of the lever means distant from the second pivot axis, and means for alternatingly feeding pressure fluid to opposite ends of the cylinder. In this construction the axes about which the one ends of the pair of drive pawls are tiltable are respectively located to opposite sides of the second pivot axis, but equally spaced therefrom.

In a further embodiment according to the present invention, the lever means is mounted on the support means midway between opposite ends thereof tiltable about the second pivot axis and the drive pawls are pivotally mounted at one of the ends thereof on the lever means tiltable about axes respectively located to opposite sides of the second pivot axis and spaced the same distance from the latter. The fluid operated cylinder-and-piston means in this construction comprise a pair of cylinders having each an axis normal to the second pivot axis and being respectively located to opposite sides of and spaced equal distances from the latter, a piston reciprocatably arranged in each of the cylinders, means for connecting the pistons respectively to opposite ends of the lever means, respectively equally spaced from the second pivot axis, and means for alternatingly feeding pressure fluid into and discharging pressure fluid therefrom. The connecting means preferably comprise a pair of piston rods having semi-spherical opposite ends respectively engaged in semi-spherical cavities in the pistons and the opposite ends of said lever means.

The novel features which are considered as characteristic for the invention are set forth in particular in the appended claims. The invention itself, however, both as to its method of operation, together with additional objects and advantages thereof, will be best understood from the following description of specific embodiments when read in connection with the accompanying drawings.

DESCRIPTION OF THE PREFERRED EMBODIMENTS

Figure 1:
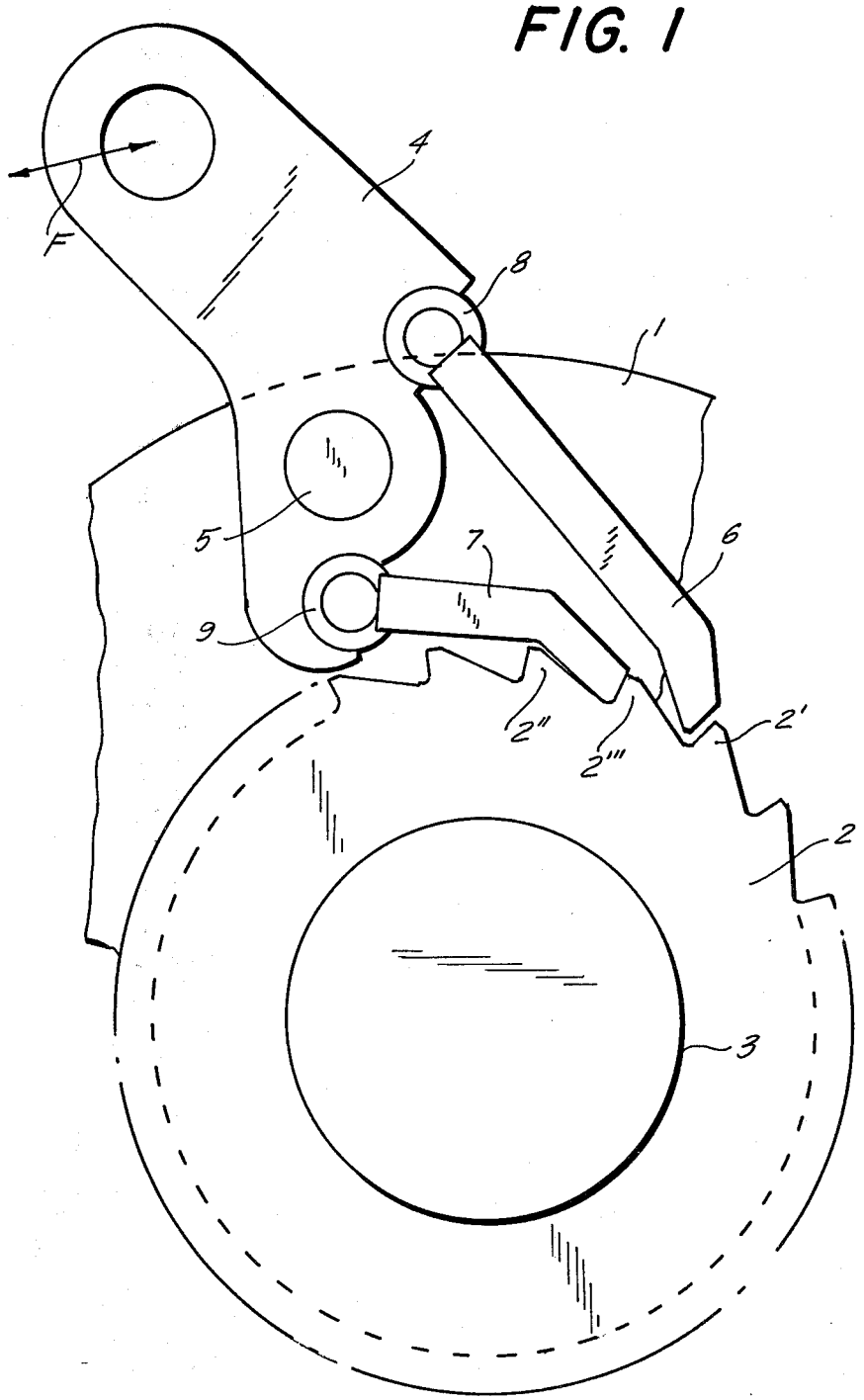
FIG. 1 is a schematic side view of the basic components of the ratchet drive according to the present invention.

Referring now to the drawing, and more specifically to FIG. 1, in which the basic construction of the ratchet drive of the present invention for a wrench or the like is illustrated, it will be seen that this ratchet drive comprises a ratchet gear 2 mounted by trunions 3, projecting to opposite sides of the ratchet gear 2, on support means which may include two transversely spaced side plates 1, of which only the rear plate is shown, for rotation about its axis. A lever 4 is tiltably mounted by its trunions 5 on the aforementioned side plates between a forward and a return stroke. The lever 4 carries two drive pawls 6 and 7, respectively mounted on the lever tiltable about trunsions 8 and 9 spaced from and respectively located to opposite sides of the trunions 5 on which the lever 4 is mounted. The lever 4 may be moved along its forward and its return stroke by a hand or any mechanical means connected thereto as indicated by the arrow F and during its forward stroke, that is in clockwise direction, the free end of the drive pawl 6 will engage the tooth 2' of the ratchet gear 2, to drive the latter in clockwise direction, while the free end of the drive pawl 7 will ratchet back over the tooth 2" of the ratchet gear. If now the lever is moved on its return stroke, that is in counterclockwise direction, the free end of the drive pawl 7 will engage the tooth 2", whereas the free end of the drive pawl 6 will ratchet back over the tooth 2'''. Thus, the ratchet gear 2 will be turned in the same direction during the forward and the return stroke of the lever 4, in contradistinction to known ratchet drives in which the ratchet gear is turned only during the forward stroke of the lever.

While the ratchet drive according to the present invention may be used for many applications, its preferred use is in a wrench for tightening or loosening a threaded connector.

Various modifications of a wrench using the ratchet drive according to the present invention are illustrated in FIGS. 2–5.

Figure 2:
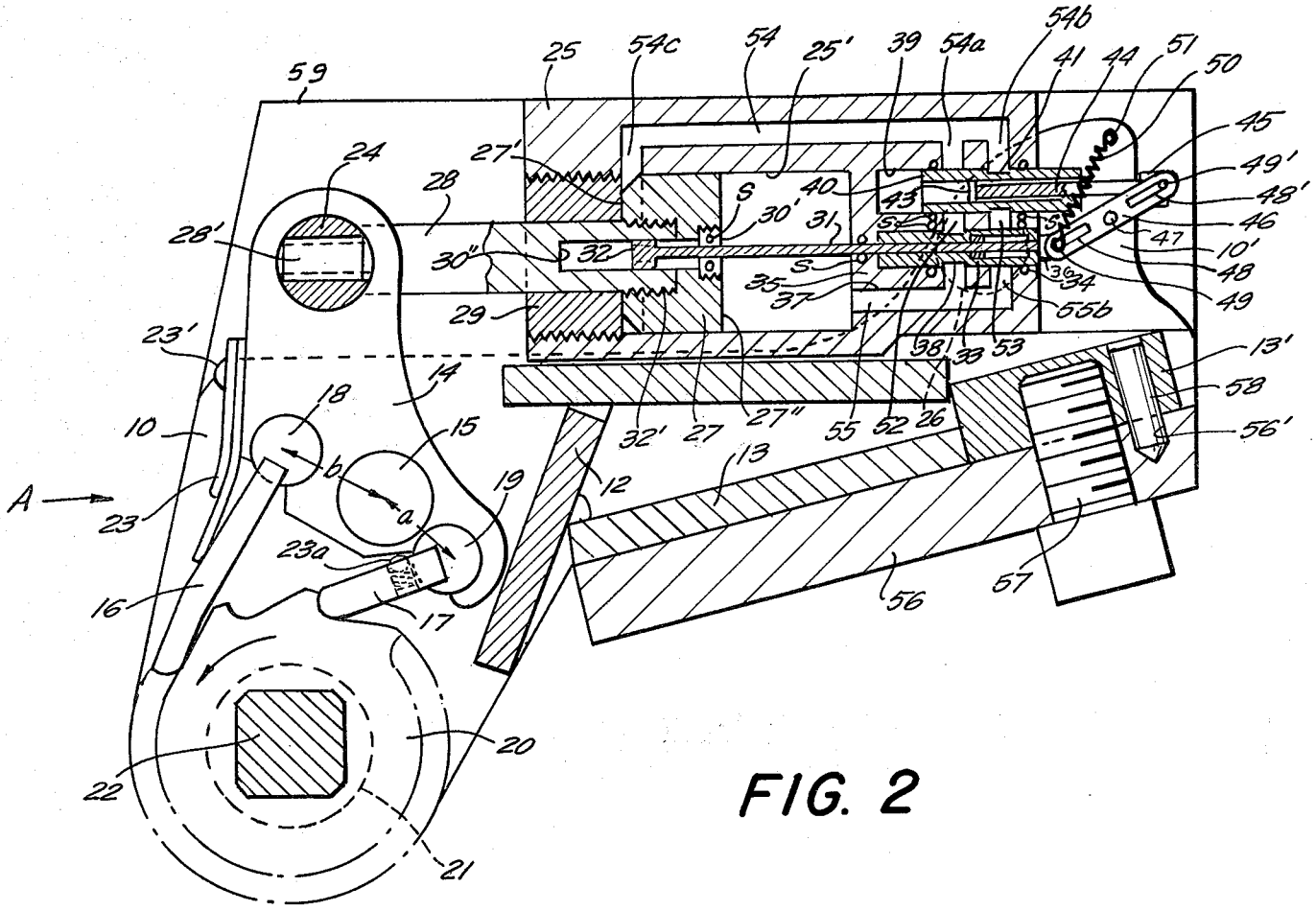
FIG. 2 is a cross section taken along the line II—II of FIG. 3 of a fluid operated wrench with a ratchet drive according to the present invention.
Figure 3:
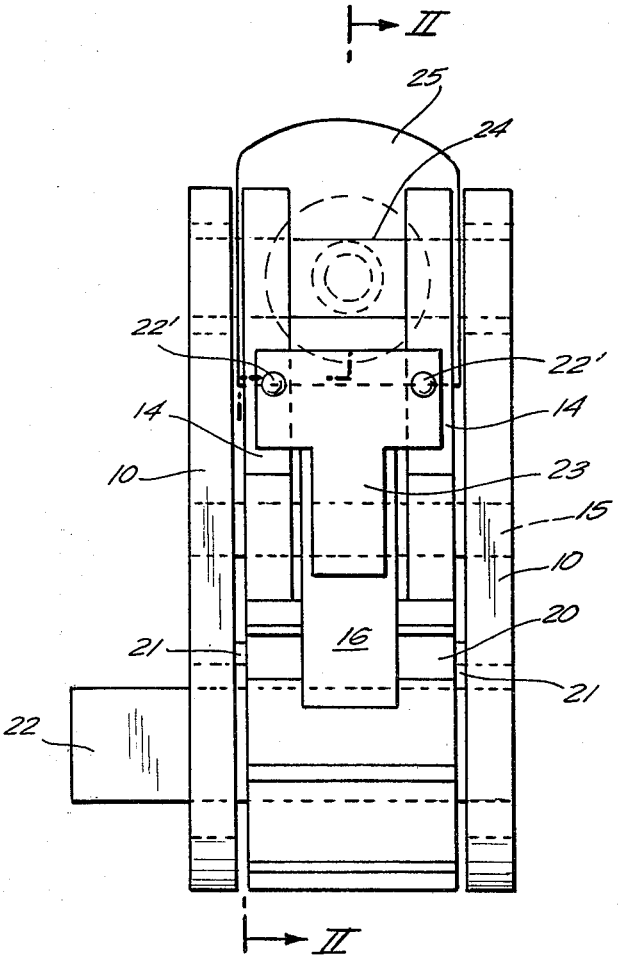
FIG. 3 is an end view of the embodiment shown in FIG. 2 as viewed in the direction of the arrow A shown in FIG. 2.

Referring now to the embodiment shown in FIGS. 2 and 3, it will be seen that this embodiment again includes support means comprising two side plates 10 transversely spaced from each other and connected to each other by transverse plates 11, 12, and 13 welded thereto, as best shown in FIG. 2. A pair of transversely spaced levers 14 are pivotally mounted between front portions of the side plates 10 tiltable about the axis of a trunnion 15 passing through bores in the levers and corresponding bores in the side plates 10. The levers 14 carry therebetween two drive pawls 16 and 17 respectively tiltably mounted on trunnions 18 and 19. A ratchet gear 20 is mounted between the side plates 10 turnable about a pivot axis which is spaced from and parallel to the pivot axis of the trunnion 15. For this purpose a pair of transversely aligned bores are formed in the front portion of the side plates 10, in which a pair of sleeves 21 are turnably mounted. The ratchet gear 20 is located between the inner flanged ends of the sleeves 21 and each of the sleeves 21 as well as the ratchet gear is formed with a substantially square passage therethrough, in which a drive member 22 of square cross section is located, projecting with one end thereof beyond one of the side plates 10, as clearly shown in FIG. 3. This projecting portion of the drive member 22 serves to exchangeably receive a standard socket, not shown in the drawing, for engagement with the polygonal head of a threaded connector to be turned. A pair of leaf springs 23 fixed at 23' to the levers 14 serve to press the drive pawl 16 in engagement with the teeth of the ratchet gear 20. A spring pressed ball 23*a* located in a bore of the drive pawl 17 serves to maintain the latter in engagement with the teeth of the ratchet gear 20.

In this construction the levers 14 are tilted about the tilting axis of the trunnion 15 by fluid operated cylinder-and-piston means, which comprise a cylinder 25 tiltably mounted in the region of the right end thereof, as viewed in FIG. 2, on trunnions 26 located in corresponding bores of upwardly projecting portions 10' of the side plates 10. A piston 27 is reciprocatably mounted in the bore 25' of the cylinder 25. A piston rod 28 connected at one end to the piston 20, by being for instance screwed in a correspondingly threaded bore of the latter, projects through a corresponding bore in a plug 29 screwed into and closing the left end of the cylinder bore 25' and the reduced threaded left end 28' of the piston rod extends through and is threadedly connected to the central portion of a pivot pin 24 extending through aligned bores of the levers 14. The right end portion, as viewed in FIG. 2, of the piston rod 28 is formed with a central bore 30 therethrough which is continued into the piston 27 and which is closed at its right end by a plug 30'. A small piston 32, formed at its outer periphery with grooves 32', is reciprocatable in the bore 30. The piston 32 has a piston rod 31 extending through a central bore of the plug 30' and carries at its right end, as viewed in FIG. 2, another small piston 33. The piston rod 31 extends through a corresponding bore in the cylinder 25 and through a central bore of a valve member 35 located in a bore 37 formed in the right portion of the cylinder 25. The small piston 33, which is likewise provided at the periphery thereof with grooves, is reciprocatable in a bore 34 provided in the right-hand portion of the valve member 35. The piston rod 31 projects with it right-hand end through an opening in the right closed end of the bore 34 and a head member 36 of a diameter greater than that of the piston rod 31 is fixedly connected in any suitable manner to the right end of the piston rod 31 to abut, in the position as shown in FIG. 2, against the right end face of the cylinder 25. The valve member 35 is provided intermediate its ends with a peripheral groove 38. The right end portion of the cylinder 25 is further formed with a second bore 39 extending parallel to the bore 37. A second valve member 40 is reciprocatable in the bore 39 projecting, in the position shown in FIG. 2, with its right hand end portion through and beyond the open right end of the bore 39 beyond the right end face of the cylinder 25. The valve member 40 is likewise formed with a central bore 42 extending partly therethrough in which a small piston 43 is reciprocatable. A piston rod 44, of smaller diameter than the piston 43 extends through a corresponding bore in the valve member 44 and carries at its outer end a head member 45. A lever 46, pivoted intermediates its ends on a pivot pin 47 turnably mounted in bores of the projecting portions 10' of the side plates 10, is formed to opposite sides of the pivot pin 47 with elongated slots 48 and 48', in which pins 49 and 49' respectively carried by the head members 36 and 45 are respectively slideably arranged. A tension spring 50 is connected at opposite ends to the pin 49 carried by the head member 36 and to a pin 51 extending between the projecting portions 10' of the side members and being vertically aligned with the pivot pin 47. In the position of the various elements as shown in FIG. 2, the peripheral groove 41 of the valve member 40 communicates with an inlet channel 53 provided in the cylinder 25 and located between and communicating with the bores 37 and 39, as well as with a branch channel 54*b* communicating with a channel 54 extending longitudinally partly through the cylinder 25 and ending at its left end, as viewed in FIG. 2, in a transverse channel 54*c* communicating with the left end of the cylinder bore 25'. Another branch channel 54*a* spaced a relatively small distance from the channel 54*b* communicates at opposite ends with the longitudinal channel 54 and the bore 39. The peripheral groove 38 in the valve member 35 communicates, in the position as shown in FIG. 2, with an outlet channel 52 provided in the cylinder 25 spaced a relatively small distance from the inlet channel 53 and communicating with the bores 37 and 39. The peripheral groove 38 in the valve member 35 communicates also with a branch channel 55*a*, communicating at the other end with a lingitudinal channel 55, which communicates at its left end, as viewed in FIG. 2, with the right end of the cylinder bore 25'. A second branch channel 55*b* at its outer end with the channel 55 and its inner end with the bore 37. The inlet channel 53 is connected in any suitable manner, not illustrated in the drawing, to a source of pressure fluid, whereas the outlet channel 52 is connected to a reservoir from which pressure fluid is pumped by a pump, not shown in the drawing. Appropriate sealing rings S are provided for the piston rod 31 and the valve members 35 and 40, as schematically shown in FIG. 2.

The wrench includes further abutment means in form of a plate 56 mounted on a screw 57 threadably connected in a correspondingly threaded bore in a boss 13' welded to the plate 13. The abutment plate 56 is provided to the right of the pivot screw 57 with a plurality of blind bores 56', of which only one is shown in FIG. 2 and which are arranged circumferentially spaced from each other along a circle coaxial with the axis of the screw 57. A pin 58 provided in a bore in the boss 13' projects into a respective bore 56' so as to hold the abutment plate 56 in any adjusted position relative to the plate 13.

The above-described wrench using the ratchet drive according to the present invention will operate as follows:

In the position of the various elements as shown in FIG. 2 a fluid under pressure, preferably oil, passes from the inlet channel 53 through the peripheral groove 41 in the valve member 40, the channels 54*b* and 54*c* to the left bevelled end of the piston 27, so that the latter moves toward the right, as viewed in FIG. 2. Before the piston 27 reaches the right end of the cylinder bore 25', the small piston 32 in the bore 30 will engage the closed left end 30'' of the bore 30 to thereby move the small piston 32 and the piston rod 31 toward the right, as viewed in FIG. 2, and thereby also the head member 36 in the same direction to thus turn the lever 46 in counterclockwise direction about its pivot pin 47. When the lever 46 is thus turned slightly beyond a position in which it extends normal to the axis of the piston rod 31, the tension spring 50 will exert a force to turn the lever 46 further in the aforementioned direction so that the head member 45 will suddenly move toward the left, as viewed in FIG. 2, to abut against the right end face of the valve member 40 to move the latter toward the left, while the small piston 33 in the bore 34 of the valve member 35 engages the right end of this bore to move the valve member 35 toward the right, so that now the peripheral groove 38 in the valve member 35 is aligned with the inlet channel 53 and the channel 55*b*, whereas the peripheral groove 41 in the valve member 40 is aligned with the outlet channel 52 and the branch channel 54*a*. Pressure fluid is now fed against the right face, as viewed in FIG. 2, of the piston 27, whereas the cylinder space to the left of the annular end face of the piston is connected to the outlet channel 52 so that the piston 27 moves toward the left, to the position shown in FIG. 2, and the levers 14 are tilted in counterclockwise direction and the pawl 16 drives the patchet wheel in the direction of the arrow x. During the movement of the piston toward the left, the small piston 32 in the bore 30 will engage the plug 30' at the right end of the bore to pull the piston rod 31 to the left, whereafter the above-described play of the valve members 35 and 40 is reversed.

Since the active area of the annular left end face 27' of the piston 27, which is reduced by the cross section of the piston rod 28, is smaller than the active area of the right end face 27'' of the piston, the force at which the lever 14 is tilted in clockwise direction. To compensate for the difference in this force, the distance a of the axis of the pivot pin 15 from the axis of the pivot pin 19 to the distance b of the axis of the pivot pin 15 to the pivot pin 18 is in reverse ratio to the active areas of the end face 27'' to the annular end face 27' of the piston 27.

When a socket is mounted on the projecting portion of the driver member 22 and engages the head of the threaded connector to turn the latter during rotation of the ratchet gear 20 in the direction of the arrow x shown in FIG. 2, a moment is applied to the whole wrench tending to turn the latter about the axis of the ratchet gear 20 in the opposite direction. To counteract this moment the abutment plate 56 is provided. For this purpose the screw 57 is loosened so that the pin 58 will become disengaged from the bore 56' in the plate 56 and the latter is turned downwardly, whereafter the screw 57 is again tightened and the pin 58 will engage into a corresponding bore 56' and the thus downwardly extending plate 56 is brought into engagement with a fixed abutment, for instance the head of another threaded connector, to counteract such moment. The wrench may be provided with a cover 59 protecting the levers 14 and the drive pawls thereon, as well as the lever 46 and the elements connected thereto from inadvertent engagement with the hands of the operator during operation of the wrench.

Figure 4:
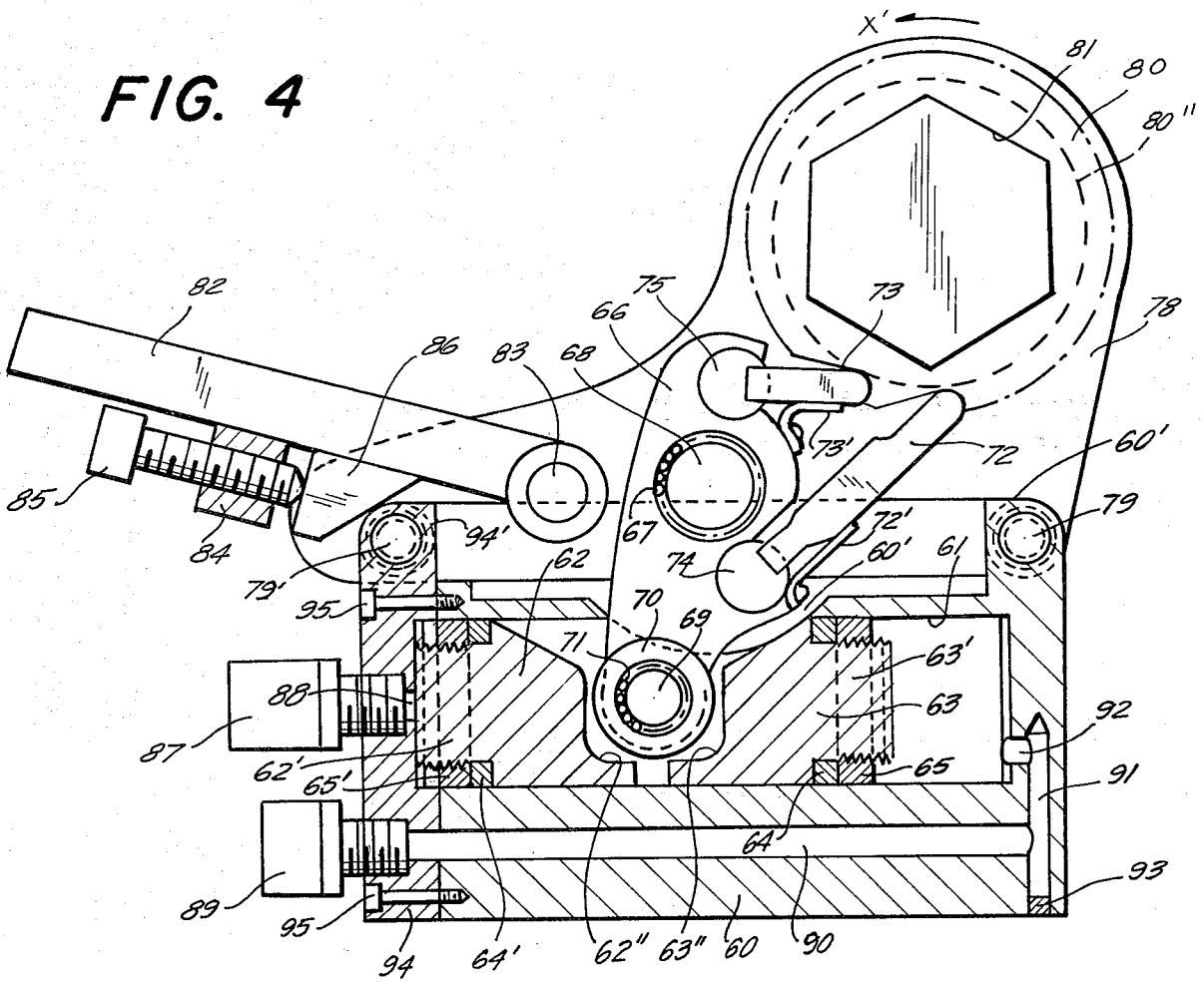
FIG. 4 is a longitudinal cross section through a second embodiment of a fluid operated wrench using the ratchet drive according to the present invention.

A second hydraulically operated wrench using the ratchet drive according to the present invention is shown in FIG. 4. This wrench includes a cylinder 60 having parallel side faces and an ear 60' projecting upwardly from the right end, as viewed in FIG. 4, from the cylinder. The cylinder 60 is formed with a cylinder bore 61, having a right closed end and a left open end, which is closed by a cover 94 connected to the cylinder by screws 95. The cover 94 has a portion 94' similar to the ear 60' projecting beyond the upper end of the cylinder 60. The cover 94 has parallel planer side faces respectively aligned with the side faces of the cylinder 60. A pair of pistons 62 and 63 are respectively reciprocatedly arranged in the cylinder bore 61. The piston 62 has an outer threaded portion 62' of a smaller diameter onto which a ring 65' is threaded to hold a sealing ring 64' between the right end face of the ring 65' and a corresponding shoulder of the piston 62. Correspondingly, the piston 63 is provided with a threaded portion 63' of smaller diameter onto which a ring 65 is threaded to hold a sealing ring 64' between the left end of the ring and a corresponding shoulder on the piston 64. The inner faces of the pistons which are directed toward each other are concavely curved as shown at 62'' and 63''. A pair of transversly spaced side plates 78, of which only the rear plate is shown in FIG. 4, are respectively connected by screws 79 and 79' to the ear 60' at the right end of the cylinder 60 and to the projecting portion 94' of the cover 94.

A pair of transversely spaced levers 66, of which again only the rear lever is shown, are pivotally mounted by means of needle bearings 67 on a pivot pin 68 having opposite ends respectively located in corresponding bores of the side plates 78 for movement between a forward stroke and a return stroke. A pin 69 extending through corresponding bores in the region of the lower ends of the levers 66 carries by means of a needle bearing 71 a roller 70 for rotation about the axis of the pin 69 and the outer surface of the roller engages the curved end faces 62'' and 63'' of the pistons 62 and 63, so that, during reciprocation of the pistons 62 and 63 in the cylinder bore 61 the levers 66 are tilted between a forward and a return stroke. The levers 66 carry between themselves a pair of drive pawls 72 and 73, respectively mounted at the rear ends thereof on pivot pins 74 and 75, which in turn are tiltably mounted at opposite ends in corresponding openings of the levers 66 to opposite sides of the axis of the pivot pin 68. In this construction the distance of the axis of the pin 75 from the axis of the pivot pin 68 is equal to the distance of the axis of the pin 74 from the axis of the pivot pin 68.

A ratchet gear 80 is mounted between the side plates 78 by means of a pair of trunnions 80'' projecting to opposite sides of the ratchet gear into corresponding holes of the side plates 78 for mounting the ratchet gear 80 turnable about an axis spaced from the pivot axis of the levers 66. The ratchet gear 80 as well as the two trunnions 80'' thereof are formed with a passage 81 of polygonal, preferably hexagonal cross section therethrough for engagement with the head of a threaded connector to be turned.

As mentioned before, during turning of a threaded connector engaged in the passage 81 in the direction of the arrow x', a moment will be produced tending to turn the whole wrench in the opposite direction about the axis of the ratchet gear and to counteract this moment an abutment plate 82 is again provided adapted to engage a fixed abutment, for instance the head of another threaded connector, adjacent to the threaded connector to be turned. The plate 82 located between the side plate 78 is pivoted at one end on a pivot pin 83 extending with opposite ends in corresponding bores in the side plates 78 and projects with its other end portion beyond the side plates 78. A lug 84 is welded to the rear face of the abutment plate 82 and a screw 85 is threaded in a correspondingly threaded bore of this lug to engage with the free end thereof another lug 86 projecting inwardly from one of the side plates 78 so that during turning turning of the screw 85 the position of the abutment plate 82 may be adjusted.

As further shown in FIG. 4 there is provided a first connector 87 for pressure fluid ending in a channel 88 through the cover 94 and a second connector 89 for pressure fluid leading through a channel 90 extending through the cover and the base portion of the cylinder and communicating through channels 91 and 92 with the other end of the cylinder bore 61. The channel 91 is closed at the outer end by a screw plug 93 or the like.

Valve means of standard construction, not shown in the drawing, serve to alternatingly feed pressure fluid through the pressure fluid connector 87 and the channel 88 to one end of the cylinder bore 61 while permitting discharge of pressure fluid from the opposite end of the cylinder bore through the channels 92, 91, and 90 and the connector 89, and vice versa, to thus reciprocate the piston means 62 and 63 in opposite directions to thereby continuously rotate the ratchet gear 80 in the direction of the arrow X'.

As further shown in FIG. 4 the free ends of the drive pawls 72 and 73 are biased in engagement with the teeth of the ratchet gear 80 respectively by springs 72' and 73'. It is further mentioned, that the cylinder wall facing the pivot pin 68 of the lever 66 is formed with an opening 60' therethrough to which end portions of the levers carrying the roller 70 extend.

The operation of the wrench illustrated in FIG. 4 and using the continuous ratchet drive according to the present invention will be evident from the above description. The head of threaded connector to be turned is first engaged in the passage 81 of the ratchet gear 80 and then the abutment plate 82 is adjusted to engage a fixed abutment adjacent to the head of the threaded connector to be turned. Subsequently thereto pressure fluid is fed through the channel 88 into the left end, as viewed in FIG. 4 of the cylinder bore 81 so that the piston means 62 and 63 move toward the right, tilting thereby the levers 66 in counterclockwise direction, so that the drive pawl 72 will turn the ratchet gear 80 and the threaded connector engaged in the passage 81 in the direction of the arrow X', while the drive pawl 73 will ratchet rearwardly over a tooth of the ratchet gear. Subsequently thereto the fluid connection will be reversed so that pressure fluid will flow through the channels 90, 91 and 92 into the right end of the cylinder bore 61, while pressure fluid is simultaneously discharged to the channel 88. The levers 66 will thereby turn in clockwise direction so that the drive pawl 73 will now engage a tooth to drive the ratchet gear 80 in the same direction while the drive pawl 72 will ratchet rearwardly over the adjacent tooth.

Figure 5:
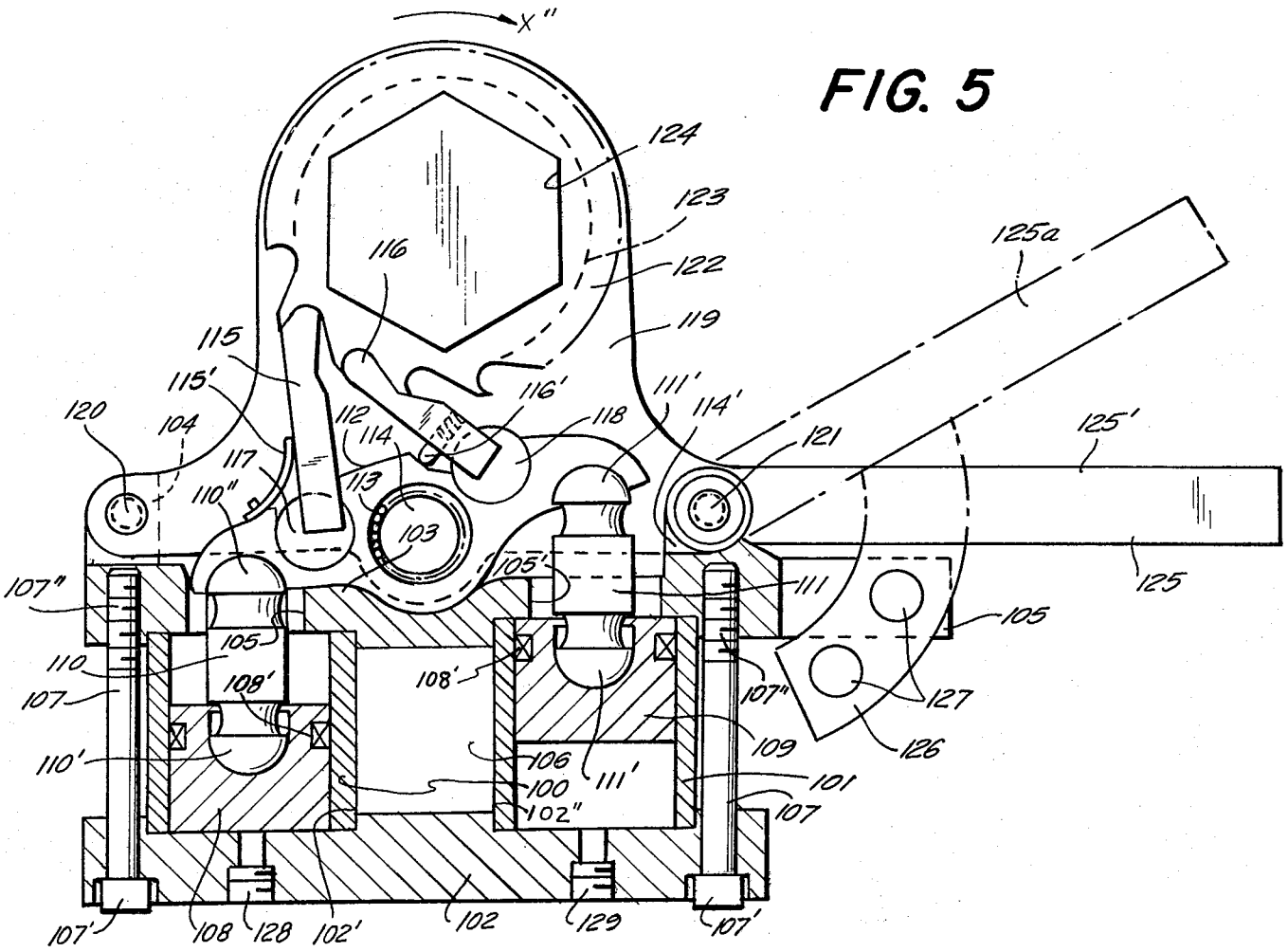
FIG. 5 is a longitudinal cross section through a third embodiment of a fluid operated hydraulic wrench using a ratchet drive according to the present invention.

A third embodiment of a wrench using the continuous ratchet drive according to the present invention is illustrated in FIG. 5.

Referring now to FIG. 5, it will be seen that the hydraulically operated wrench disclosed therein comprises two cylindrical sleeves 100 and 101 having opposite open ends, over which a bottom plate 102 and a cover plate 103 respectively extend, connected to each other by screws 107 having each a head 107' located in a corresponding cutout of the bottom plate 102 and an opposite threaded end portion 107'' screwed in two correspondingly threaded bores in the cover plate 103. The bottom plate 102 is provided with a pair of transversely spaced cylindrical depressions 102' and 102'' and the top plate 103 is provided with corresponding transversely spaced depression 103' and 103'', in which end portions of the cylindrical sleeves 100 and 101 are respectively seated. Sealing rings S are provided on the lower ends of the sleeves 100 and 101 to properly seal these lower ends in the aforementioned depressions formed in the bottom plate 102. The cover plate 103 is further provided at each of the opposite ends with a pair of transversely spaced ears 104 and 104', of which only the rear ears are shown in FIG. 5.

A pair of pistons 108 and 109 are respectively reciprocatably arranged in the interior of the cylindrical sleeves 100 and 101. The piston 108 is provided with a sealing ring 108' and the piston 109 with a corresponding sealing ring 109'. A pair of piston rods 110 and 111 are respectively coordinated with the pistons 108 and 109. The piston rod 11 has a lower semispherical end portion 110' located in a corresponding cavity of the piston 108 and the piston rod 110 projects through an opening 105 in the cover 103 and has an opposite likewise semispherical end portion 110''. Likewise, the piston rod 111 has a lower semispherical end portion 111' located in a corresponding cavity of the piston 109 and extends through an opening 105' of the cover plate 103 and has likewise a semispherical opposite end portion 111'.

The opposite end portions 110'' and 111'' are respectively engaged in correspondingly shaped cavities of a lever 112, tiltably mounted by means of a needle bearing 113 on a pivot pin 114, the opposite ends thereof are mounted in corresponding bores of a pair of transversely spaced side plates 119, only one of which is shown in FIG. 5, which are connected by screws 120 and 121 to the aforementioned ears 104 and 104'. The lever 112 carries between the side plate 119 a pair of drive pawls 115 and 116, the inner ends of which are tightly seated, respectively fixedly connected in any suitable manner, to pivot pins 117 and 118, respectively pivotally arranged in corresponding part cylindrical bores formed in the lever 112. The outer ends of the drive pawls 115 and 116 engage the teeth of a ratchet gear 122, having opposite trunnions 123 respectively engaged in bores of the side plates 119 and having axes parallel and laterally spaced from the pivot axis of the pin 114. The trunnions 123 and the ratchet gear are formed with a polygonal, preferably hexagonal passage 124 therethrough for engagement with a corresponding head of a threaded connector to be turned by the wrench. A leaf spring 115' fixed at one end in any convenient manner to the lever 112 and engaging with the other end thereof the drive pawl 115 serves to maintain the outer end of this drive pawl in engagement with the teeth of the ratchet gear 122. A spring pressed pin 116' located in a bore of the drive pawl 116 and engaging with its outer end a face portion of the lever 112 also serves to maintain the outer end of the drive pawl 116 in engagement with the teeth of the ratchet gear 122.

As mentioned before, during rotation of the ratchet gear 122 in the direction of the arrow X'' to thereby tighten the head of a threaded connector engaged in the passage 124, a moment will be created to turn the whole wrench in the opposite direction about the axis of the ratchet gear. To counteract this moment there is again provided an abutment plate 125 tiltably mounted at its inner end between the ears 104' and adapted to engage with its face 125' a fixed abutment, for instance the head of another threaded connector adjacent to the threaded connector engaged in the passage 124. To adjust the position of the abutment plate 125 relative to the remainder of the wrench, a curved wing 126 projects from the face of the plate 125 opposite to the face 125' thereof. The wing 126 is provided with a plurality of spaced bores 127 therethrough and a pin may extend through one of the bores and a bore provided in a lateral extension 105 projecting from the cover 103 to one side of the wing 126, so as to maintain the abutment plate 125 either in the full line position or in the dotted line position **125*a* depending on the position on the fixed abutment to be engaged by the face 125' of the abutment plate. Of course, the wing 126 may be extended and more than two holes 127 may be provided therein to permit different angular adjustment of the abutment plate 125**.

The bottom plate 102 is further provided with a pair of passages 128 and 129 therethrough respectively communicating at the inner ends with the interiors of the cylindrical sleeves 100 and 101. Threaded connectors, not shown in FIG. 5, similar to the connectors 87 and 89 shown in FIG. 4, are to be connected to the threaded portion of the passages 128 and 129 and valves of known construction, not shown in the drawing, are connected to the fluid lines leading to the threaded connectors for alternatingly feeding pressure fluid into, respectively discharging pressure fluid from the passages 128 and 129.

The operation of the hydraulically operated wrench shown in FIG. 5 will be obvious from the above description. If pressure fluid is fed into the passage 128, while fluid is discharged from the passage 129, the piston 108 will tilt the lever 112 in clockwise direction about the pivot pin 114, so that the drive pawl 115 will drive the ratchet gear 128 in the direction of the arrow X", while the outer end of the drive pawl 116 will ratchet rearwardly over a corresponding tooth. When subsequently thereto pressure fluid is fed through the channel 129, while pressure fluid is discharged from the channel 128, the lever 112 will be tilted in counterclockwise direction, so that the drive pawl 116 will drive the ratchet gear in the same direction as indicated by the arrow X", while the outer end of the drive pawl 115 will ratchet backward over an adjacent tooth.

It will be noted that in all three embodiments shown in FIGS. 2–5 the outer ends of the drive pawls are convexly curved, whereas the flanks of the teeth engaged by the outer ends of the drive pawls are correspondingly concavely curved.

It will be understood that each of the elements described above, or two or more together, may also find a useful application in other types of continuous ratchet drives, especially for use in fluid operated wrenches differing from the types described above.

Wile the invention has been illustrated and described as embodied in fluid operated wrenches using the continuous ratchet drive according to the present invention, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without emitting features that, from the standpoint of prior art, fairly constitute essential characteristics of the generic or specific aspects of this invention.

What is claimed as new and desired to be protected by Letters Patent is set forth in the appended claims:

1. A continuous fluid-operated ratchet drive for a wrench or the like comprising support means; a ratchet gear mounted on said support means turnable about a first pivot axis; lever means pivotable about a second pivot axis extending laterally from and parallel to said first pivot axis; fluid-operated cylinder and piston means comprising a cylinder, a piston reciprocatably arranged in said cylinder along a forward stroke and a return stroke and a piston rod fixed at one end to said piston and projecting with its other end in a sealed manner through one end of said cylinder and connected to said lever means distant from said second pivot axis, whereby during said forward stroke of said piston the pressure fluid acts on one end face thereof and during the return stroke on an annular piston face, the area of which is reduced by the cross section of the piston rod as compared to the area of said one piston face, so that the force with which the piston is moved during the return stroke is smaller than that at which it is moved during said forward stroke; and at least one pair of drive pawl means having free ends adapted to engage teeth of said ratchet gear, said pair of drive pawl means being mounted at one end thereof opposite said free ends on said lever means tiltable about tilting axes located spaced from and respectively to opposite sides of said second pivot axis and wherein the distance of the tilting axis of one of said drive pawl means from said pivot axis to the distance of said pivot axis from the tilting axis of the other driven pawl means is in reverse ratio to said forces at which said piston is moved during its forward and its return stroke, whereby said ratchet gear is turned in one direction and with the same force during the forward as well as during the return stroke of said piston in said cylinder.

* * * * *